United States Patent [19]

Rothenberger

[11] 4,144,735

[45] Mar. 20, 1979

[54] MOUNTING FOR THE EXCHANGEABLE SETS OF EXPANDING ELEMENTS OF TOOLS FOR ENLARGING THE ENDS OF PIPES

[75] Inventor: Günter Rothenberger, Bad Homburg-Dornholzhausen, Fed. Rep. of Germany

[73] Assignee: Rothenberger GmbH & Co Werkzeuge-Maschinen KG, Frankfurt am Main, Fed. Rep. of Germany

[21] Appl. No.: 873,588

[22] Filed: Jan. 30, 1978

[30] Foreign Application Priority Data

Feb. 4, 1977 [DE] Fed. Rep. of Germany ..... 2704638
Nov. 4, 1977 [DE] Fed. Rep. of Germany ..... 2749345

[51] Int. Cl.[2] ..... B21D 39/08
[52] U.S. Cl. ..... 72/393; 72/477; 72/481; 206/372
[58] Field of Search ..... 72/393, 477, 481; 206/349, 372, 375

[56] References Cited

U.S. PATENT DOCUMENTS

| | | | |
|---|---|---|---|
| 888,239 | 5/1908 | Kelly | 72/393 |
| 907,396 | 12/1908 | Passat | 72/393 |
| 1,961,450 | 6/1934 | Peterson | 206/375 |
| 2,180,572 | 11/1939 | White | 206/375 |
| 3,164,045 | 1/1965 | Kennedy | 72/477 |
| 4,034,591 | 7/1977 | Rothenberger | 72/393 |

*Primary Examiner*—Lowell A. Larson
*Attorney, Agent, or Firm*—Sprung, Felfe, Horn, Lynch & Kramer

[57] ABSTRACT

A device for mounting exchangeable flanged sets of expanding elements on a tool for enlarging the ends of pipes. The tool comprises a tool body having an expanding mandrel and a removable cap for retaining the sets of elements on the mandrel. The device comprises a carrier having a plurality of orifices each for the insertion of one set of expanding elements. The carrier is removably mounted on the tool body and the sets of expanding elements are releasably retained in the orifices.

13 Claims, 5 Drawing Figures

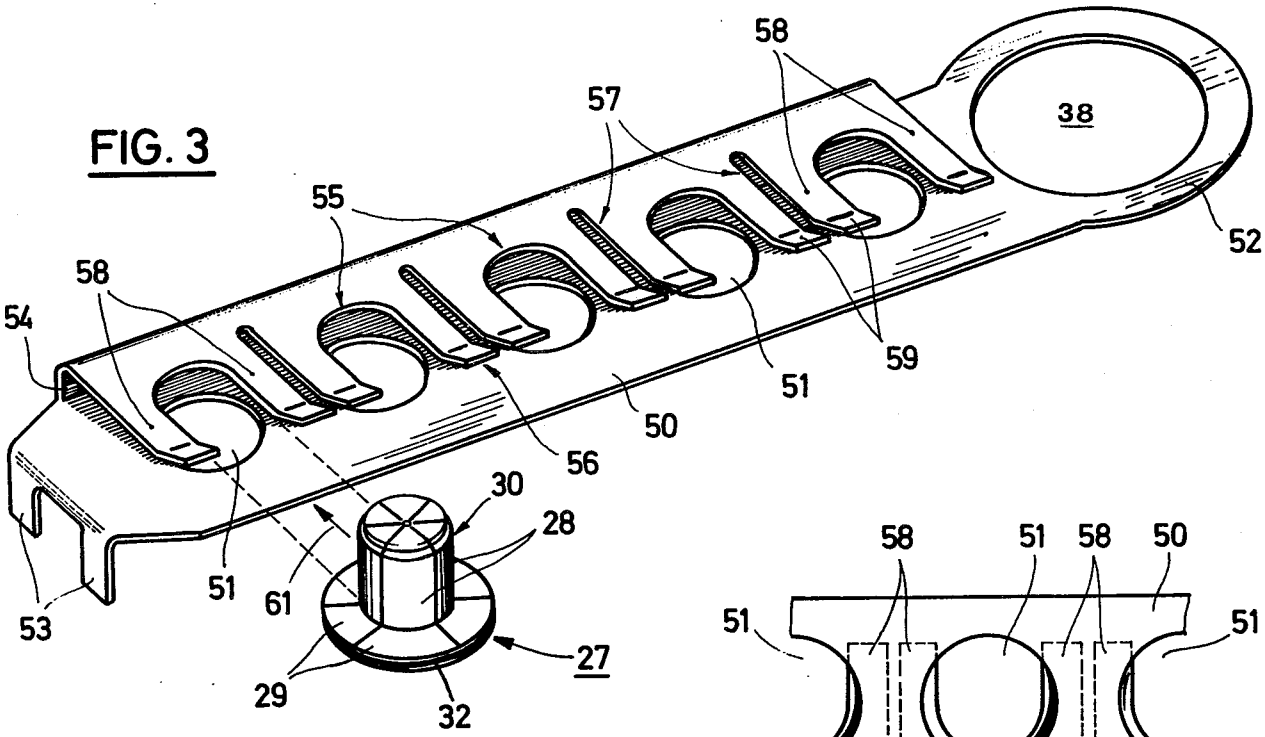
FIG. 3
FIG. 4
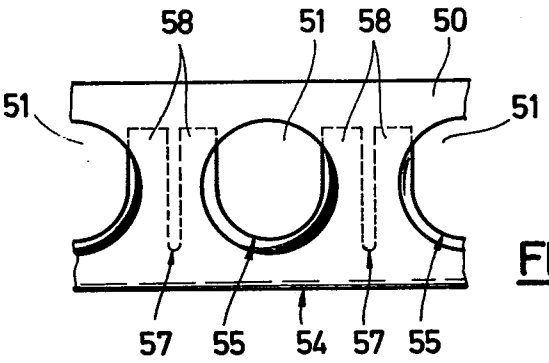
FIG. 5

MOUNTING FOR THE EXCHANGEABLE SETS OF EXPANDING ELEMENTS OF TOOLS FOR ENLARGING THE ENDS OF PIPES

BACKGROUND

The invention relates to a mounting for the exchangeable flanged sets of expanding elements of tools for enlarging the ends of pipes which tools each consist of a tool body having an expanding mandrel and of a removable cap for retaining the sets of elements on the mandrel.

Tools for enlarging the ends of pipes and having exchangeable expanding heads or sets of elements of the above-described kind are quite well known. In these tools, a tool body or basic tool generally incorporates a plurality of sets of elements, the cylindrical working faces of which have different diameters. Thus, the ends of pipes of different diameters can be enlarged with the same basic tool. When producing the sets of elements, a solid cylinder having a peripheral flanged edge and a tapered coaxial cavity complementary to the tapered end of the expanding mandrel is first formed. The cylinder is then divided into segments, the material removed by the dividing operation providing room for radial compression of the expanding elements which are arranged in a circle. The flanged edge is used for guiding the segments in the cap. In this condition, the expanding elements can be introduced into the unenlarged end of a pipe and can be pushed outwards under the action of the expanding mandrel until the elements have reached that position corresponding to the original solid cylinder. Threaded spindles, hydraulic or pneumatic piston-and-cylinder units can be used as the means for driving the expanding mandrel. A pincer-like hand implement is created by fitting a lever to the tool body and by means of an eccentric or cam which is arranged in the tool body and on which is provided a second lever (German Patent Specification OS 25 05 915).

In the known tools, the sets of expanding elements are displaceably connected to the cap, but can become detached therefrom and mislaid, and they are guided by means of rivets for example (U.S. Patent 2,999,529). Expanding heads of this kind are several times larger and heavier than the sets of elements as such and are therefore generally placed in sheet-metal chests which are also used for accommodating the tool body. It is inconvenient if not actually impossible to carry around a sheet-metal chest of this kind on building sites and particularly up and down ladders.

It is also known not to secure the expanding elements to the cap but to fit them therein in the manner whereby they can be exchanged (German Patent Specification AS 24 59 506). In this arrangement however it is not possible to exchange the self-contained sets of elements but only to remove individual elements, for which purpose the spring element necessary for retracting and retaining the expanding elements has to be removed and refitted. The changing of individual expanding elements is therefore intended only as an aid in effecting repairs, so that the user, if requiring several sets of expanding elements, regularly carries around complete expanding heads in the known sheet-metal chests.

It has been proposed to design the sets of expanding elements in such manner that they can be removed from the cap as a self-contained set and kept together so that none of the elements can be mislaid. This results in a considerable saving in weight and space so that the user is able to carry around a larger number of sets of expanding elements.

SUMMARY

The object of the present invention is to provide a mounting for expanding elements that requires no sheet-metal chest and that enables several sets of expanding elements to be carried around even in working areas that are difficult to reach.

According to the invention, this object is achieved in that the mounting for the expanding elements consists of a carrier having a plurality of orifices for insertion of the sets of expanding elements, and having fixing means for fitting the carrier on the tool body, the mounting also comprising at least one holder for the sets of expanding elements.

In following the teaching of the invention, it suffices if the mounting for the expanding elements is a plate-like carrier of relatively thin sheet metal which may be strengthened by being suitably profiled. The width of the orifices corresponds to the diameter of the sets of expanding elements immediately below the flange, so that the sets of elements can be inserted into the orifices and can bear against the carrier at their flanges. The holder then enables one or more sets of expanding elements to be removed. Due to the possibility of fitting the mounting for the expanding elements on the tool body, the mounting is combined with the tool so that the user, when carrying the tool, has one hand free. A mounting for five sets of expanding elements of average size has a length of approximately 25 cm and a width of approximately 5 cm, and is therefore relatively small and light in weight.

The fixing means used may be clips for example with which the mounting for the expanding elements can be fitted on a lever associated with the tool body. In the great majority of tool bodies used, which are provided with a screw-thread and in which the cap is a box nut having an opposite screw-thread, the fixing means can very advantageously take the form of a hole in the carrier which is used for fitting the carrier on the screw-thread on the tool body, so that the plate can be screwed on at that point by means of the cap so that it cannot become mislaid.

If the tool body is of pincer form, the mounting for the expanding elements can be fitted on the tool in a particularly efficient manner if the carrier consists of an elongate sheet-metal strip and if the orifices for inserting the sets of expanding elements and the hole for fitting the carrier on the tool body are arranged in a row along the longitudinal axis of the carrier. A mounting of this kind for the expanding elements can also be readily attached to a boiler suit, for example by passing a belt through it, without hindering the movements of the user.

The holder for the sets of expanding elements can then consist quite simply of an elongate bowed member, which is hinged at one end to the carrier and can be brought into engagement with the carrier at its free end, this bowed member lying across the flanges of all the sets of expanding elements. It is however also possible to provide a separate holder for each of the sets of expanding elements so that, with the exception of the set that has just been removed, all the sets are retained in a reliable manner.

In a further embodiment of the invention, the above-stated object is achieved in that the or each holder consists of spring elements secured in pairs along the carrier, which spring elements form, between each adjacent pair thereof, openings for the several sets of expanding elements, and which are spaced from a carrier by a distance corresponding to the thickness of the flanges of the sets of expanding elements.

Such a device will generally be so formed that the spring elements, at least over a substantial portion of their free length, are disposed parallel or substantially parallel to the surface of the carrier. This arrangement enables the flanges of the several sets of expanding elements to be readily pushed in from the side under the spring elements, and the expanding elements themselves, which project from the plane of the flanges, are reliably and accurately aligned and secured between the spring elements. Due to the arrangement of the spring elements in pairs, each set of expanding elements is secured in a positive manner by a spring element at diametrically opposite points on the flange, so that it is possible to push out individual sets of expanding elements sideways, while the remaining sets continue to be safely secured. Nor do slightly bent portions in the carrier interfere with the safe retention of the individual sets of expanding elements.

The several spring elements can be formed in a particularly advantageous manner by partial stamping from a sheet-metal strip and by alternately forming orifices for the sets of expanding elements, and spacing gaps in a row. Spring steel can be used as the sheet-metal material, though the usual structural steels also have sufficient elasticity which enables the flanges, which may vary slightly in depth, to be inserted in a positive manner between the carrier and the two associated spring elements. Because the spring elements are stamped from sheet metal they necessarily take the form of leaf springs. The formation of the spring elements partially by stamping enables them to be interconnected at one of their ends and to form a kind of continuous strip with alternating slit-like openings therein. In this way a structure of large area consisting of spring elements or tongues is formed, which elements or tongues impart an enclosed appearance to the mounting for the expanding elements and reduces to a minimum the possibility of dirt settling in dead corners and of the mounting becoming hooked on to other equipment.

Expediently, the orifices for the sets of expanding elements, and the separating gaps having open ends extend at right-angles to the outer edge of the sheet-metal strip. The spring elements thus acquire the appearance of a comb having alternate wide and narrow gaps between its teeth, the wide gaps being for receiving the pushed-in sets of expanding elements. The separating gaps between each two adjoining spring elements enable these elements to move independently of each other so that the retaining force of spring elements associated with adjoining orifices is not reduced. If the orifices, particularly those for mounting the expansion elements, are well rounded, mechanical overloading is precluded.

The subject-matter of the invention enables carriers and spring elements to be produced in an extremely simple manner, i.e. by forming the carrier and the spring elements from a sheet-metal strip bent to the shape of a U, the spring elements being arranged in one limb of the U, and the other limb forming the carrier, and the width of the base of the U corresponding to the thickness of the flanges of the sets of expanding elements. In producing such a mounting for expanding elements use is made of a procedure wherein first a flat comprising orifices and separating gaps and corresponding to the developed form of the mounting is stamped from a piece of metal sheet, which flat is then bent to the shape of a U having the stated features. This procedure eliminates the need for connecting the spring elements to the carrier in a separate operation.

The subject-matter of the invention can also be advantageously formed by providing the carrier with openings which are aligned with the orifices for the sets of expanding elements. These openings, which are preferably circular and are arranged coaxially with the semi-circular rounded ends of the orifices, constitute viewing means since, for the purpose of identifying the various sets of expanding elements, markings are punched on the surfaces of the flanges that face away from the expanding elements and these markings indicate the diameter of the set, i.e. the diameter of pipe on which the set is to be used. Such punched markings can be readily observed through the openings.

Finally, the mounting for the expanding elements may also be formed by providing the carrier, at that of its ends facing away from the fixing means, with two angled tongues, the space between which corresponds to the width of a lever associated with the tool for expanding the ends of pipes. It has been stated above that the mounting for the expanding elements can be secured to the tool for expanding the ends of pipes by screwing it on between the tool body and the cap for holding the sets of elements in position. Since the usual tools for enlarging the ends of pipes are of pincer form having two levers or grips, the two angled tongues, which embrace one of the levers, prevent twisting or swinging on the tool. Furthermore, the angled tongues serve as pedestals when the mounting for the expanding elements is placed on a flat surface for example.

Further advantageous constructional features will be seen from the other subsidiary claims and from the description.

DESCRIPTION OF THE DRAWING

Two embodiments of the subject-matter of the invention will now be described in greater detail by reference to the drawings, in which:

FIG. 3 is a perspective illustration of a further embodiment, FIG. 4 is a likewise perspective illustration of a set of expanding elements in a position in which it can be inserted from the side into the mounting shown in FIG. 3, and FIG. 5 is an underneath view of a portion of the mounting shown in FIG. 3.

DESCRIPTION

Figure 1:
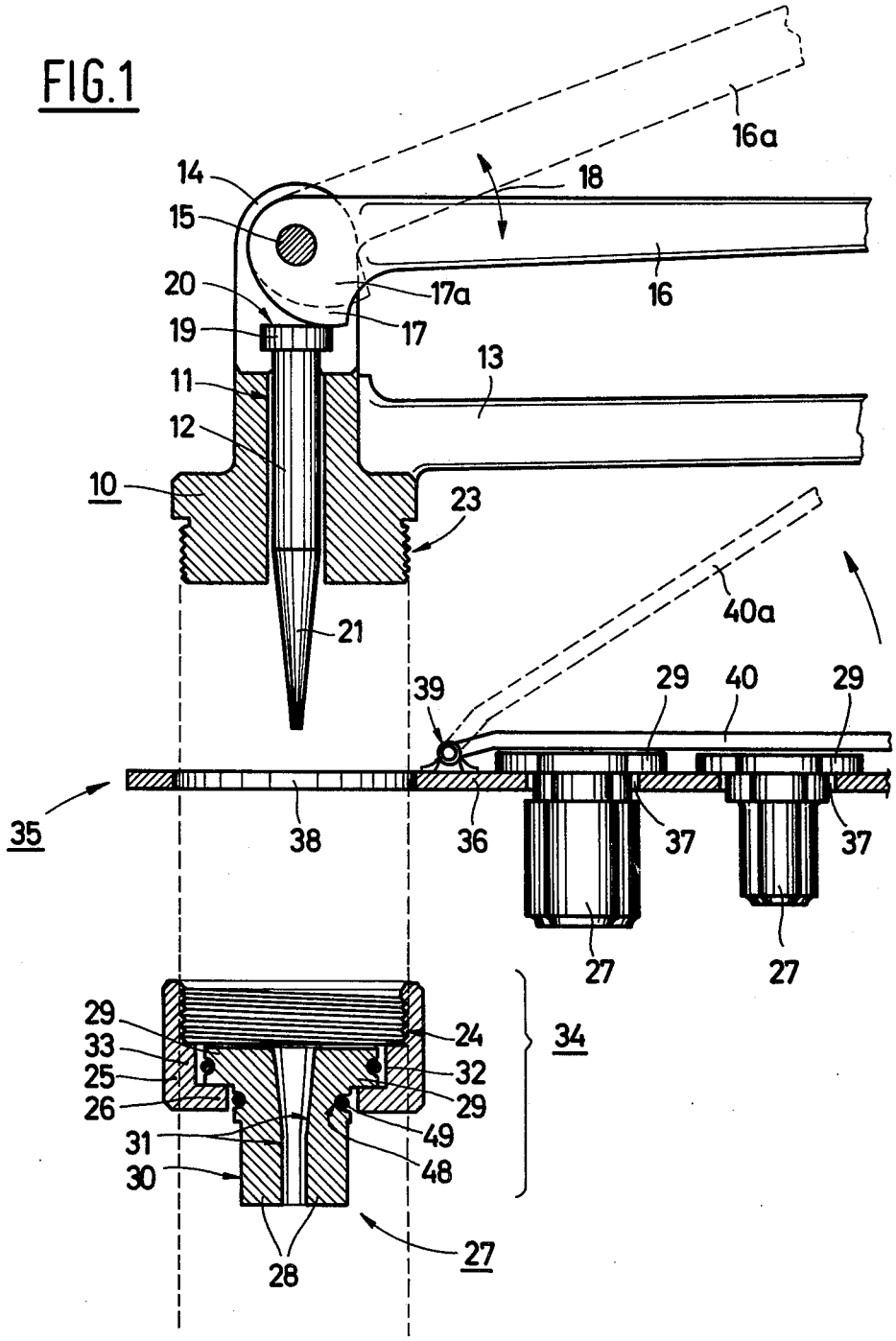
FIG. 1 is an exploded longitudinal section through a tool for enlarging the ends of pipes and comprising grips and a drive mechanism, a mounting for the expanding elements with the sets of expanding elements fitted therein, and an expanding head.

Referring to FIG. 1, a body 10 of a tool for enlarging the ends of pipes has an outer surface of substantially rotation-symmetrical form and contains a longitudinally displaceable expanding mandrel 12 in a coaxial bore 11 formed therein. Secured to the tool body 10 is a radial lever 13. The upper end of the tool body 10 is milled away at 14, where a further lever 16 is mounted by means of a hinge-pin 15, this lever having a cam 17 near the hinge-pin. The lever 16 can be swung in the direction of the arrow 18 through the position 16*a* shown in broken lines, the cam 17 occupying the position 17*a*.

At its upper end, the expanding mandrel 12 has a head 19 having an end-face 20 on which the cam 17 acts. At its lower end, the expanding mandrel 12 comprises a gently tapering portion 21 which projects from the tool body 10. The latter has a screw-thread 23 for receiving a cap 26 having an opposite thread 24. The cap 25 has an inwardly directed flange 26 and thereby surrounds a self-contained set 27 of expanding elements 28. These elements have flange segments 29 which together form an annular flange, and working surfaces 30 which together form a cylindrical surface when the illustrated expanded position is reached. The expanding elements 28 have inner surfaces 31, the shape of which complements the geometry of the tapering portion 21 and which form the surfaces over which the tapering portion slides during the expanding movement.

A spring element 32 surrounds and biases the flange segments 29 and consists of a solid spring which is bent to a circular shape and which urges the expanding elements towards each other and against the tapered portion 21. An annular projection 33 has an inside diameter equal to the outside diameter of the flange segments when fully expanded, and this projection thus forms a radial abutment. At the place where the expanding elements 28 extend through the flange 26, they are provided with a machined annular groove 48 in which is inserted a further spring element 49. The parts 24 to 33 and 48 and 49 together form an expanding head 34. The set 27 of expanding elements can be all removed together from the cap 25, this being a very important prerequisite.

Between the tool body 10 and the expanding head 34 is located a mounting 35 for the expanding elements, which mounting consists of a carrier 36 with orifices 37 for the insertion of a plurality of sets 27 of expanding elements, and with a hole 38 for fitting the carrier on the screw-thread 23 of the tool body 10. Mounted on the carrier 36 is a connector plate 39 in which is hinged a holder 40. The holder 40 has to be brought into the position 40*a* shown in broken lines so that the sets 27 of expanding elements can be removed as required. As will be seen from FIG. 1, the carrier 36 can first be fitted on the screw-thread 23 of the tool body 10 by means of the hole 38, after which it is secured in that position by screwing on the cap 25.

Figure 2:
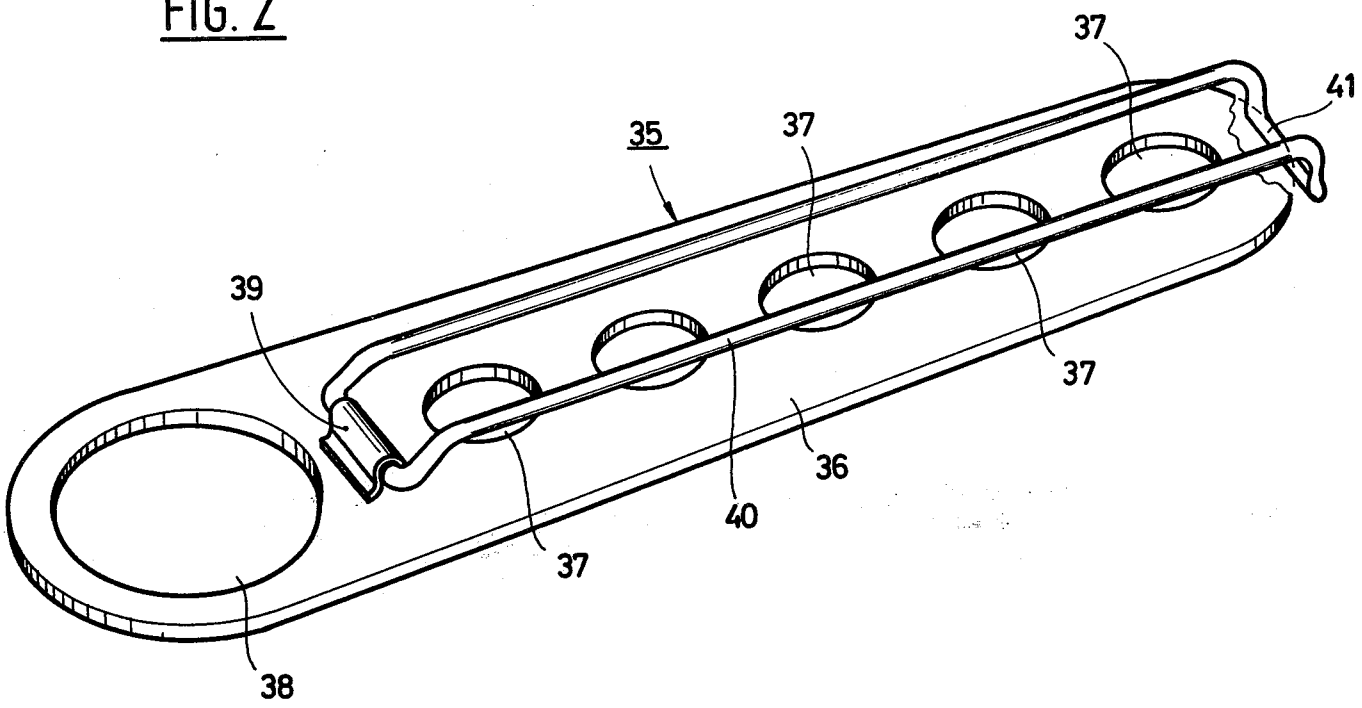
FIG. 2 is a perspective illustration of a mounting for the expanding elements as shown in FIG. 1 but without the sets of expanding elements inserted therein.

As shown in FIG. 2 in which the same reference numerals as in FIG. 1 are used for like parts, the carrier 36 consists of an elongate sheet-metal strip, and the orifices 37 for inserting the sets of expanding elements and the hole 38 for fitting the carrier on the tool body are arranged in a row along the longitudinal axis of the carrier. The holder consists of a hair-pin shaped wire loop which is hinged at one of its ends to the carrier 36 by means of the connector plate 39, and has a bent clip-shaped portion 41 at its free end, by means of which portion it can be brought into engagement with the carrier 36. This is achieved by the inherent elasticity of the holder 40 in conjunction with a precise shaping of the bent portion 41 to match the edge of the carrier 36 from which said free end can be disengaged to enable the sets of expanding elements to be inspected. The distance between the two limbs of the holder 40 is so selected that the holder lies across the sets of expanding elements so that they cannot be mislaid.

The mounting for the expanding elements as shown in FIG. 3 consists of a carrier 50 in the form an elongate sheet-metal strip having a thickness of approximately 1 to 2 mm and provided, along its longitudinal axis, with a plurality of openings 51, the number and spacing of which correspond to the number and size of the sets of expanding elements to be accommodated. At one of its ends, the carrier 50 is provided with a fixing means 52 for securing the mounting for the expanding elements on the tool for enlarging the ends of pipes. The fixing means 52 is in the form of an annulus having a hole 38 and constituting an extension of the carrier 50. The diameter of the hole corresponds to the outside diameter of that portion of the tool enlarging the ends of pipes on which the mounting for the expanding elements is to be fitted, said outside generally being the diameter of the screw-threaded portion 23 on to which the cap for retaining the sets of expanding elements is screwed (FIG. 1). At the opposite end the carrier 50 is provided with two tongues 53 which are bent over at right-angles and the gap between which corresponds to the width of the lever 13 of the tool for enlarging the ends of pipes as shown in FIG. 1.

At the top, the carrier 50 is extended by a bridge portion 54, the width of which is equal to or slightly greater than the thickness of the flanges of the sets of expanding elements. The bridge portion 54 is in turn extending forwardly by being bent substantially at right-angles, i.e. substantially parallel to the carrier 50, and is punched out as later described herein. In this way the mounting for the expanding elements acquires the shape of a U having relatively long limbs and a relatively narrow base or bridge portion 54. This form of construction makes it possible to use particularly thin sheet-metal for producing the carrier 50, since this acquires increased inherent rigidity because of the U-shaped configuration.

In the upper limb illustrated in FIG. 3 are formed a total of five orifices 55 for the several sets of expanding elements, these open-ended orifices being at right-angles to the noncontinuous outer edge 56. At their closed ends, the orifices 55 are of semi-circular rounded form, the diameter of the semi-circle corresponding to the diameter of the expanding elements. The centre-points of the semi-circles and of the openings 51 are coaxial with each other, this arrangement being discussed in greater in connection with FIG. 5. At a midway point between each pair of adjacent orifices 55 there are formed slot-like separating gaps 57 which are each formed by punching out a very narrow strip of sheet-metal. The orifices 55 and the separating gaps 57 alternate with each other in a row. In this way spring elements 58 are formed, the free ends 59 of which are bent slightly upwards so as to facilitate the insertion of the sets of expanding elements thereunder. The distance between the lower faces of the spring elements 58 and the inner surface of the carrier 50 corresponds to the thickness of the flanges of the sets of expanding elements, allowance of course being made for the elastic properties of the spring elements 58. The longitudinal axis of the separating gaps 57 also extend at right-angles to the outer edge 56 of the sheet-metal strip.

FIG. 4 illustrates a set 27 of expanding elements as described by reference to FIG. 1. The width of the orifices 55 corresponds substantially to the diameter of the expanding elements 28 i.e. to the working surfaces 30 in the position illustrated in FIG. 4, it being of course necessary to allow for slight play. The article shown in FIG. 4 can be inserted into the orifice 55 in the direction of the arrow 61 and along the broken lines in such a way that the flange segments 29 pass below the spring elements 58 and are safely retained in this position. The same conditions also obtain in the case of the other spring elements and orifices into which the sets of expanding elements, having different sizes of working faces 30, can be inserted. The separating gaps 47 enable the spring elements disposed on both sides of each gap to move independently of each other so that the adjacent sets of expanding elements are each secured independently of each other. The spring elements 58 constitute the holders for the sets 27 of expanding elements.

Also, FIG. 5 shows how the circular edges of the orifices 55 register with the openings 51 in the carrier 50. The lower faces of the flange segments 29 can be viewed through the openings 51 so that markings punched into these flange segments are visible to the viewer.

I claim:

1. A device for mounting exchangeable flanged sets of expanding elements on a tool for enlarging the ends of pipes which tool comprises a tool body having an expanding mandrel and a removable cap for retaining the sets of elements on the mandrel, the device comprising a carrier having a plurality of orifices each for the insertion of one set of expanding elements, means for removably mounting the carrier on the tool body and means for releasably retaining the sets of expanding elements in the orifices.

2. The device according to claim 1, wherein the tool body comprises a screw-thread and the cap is a box nut having an opposite screw-thread, wherein the removable mounting means comprises an additional hole in the carrier for fitting the carrier on the screw-thread on the tool body, so that the carrier can be screwed on to the tool body by means of the cap.

3. The device according to claim 2, wherein the carrier comprises an elongate sheet-metal strip, and the orifices for inserting the sets of expanding elements, and the hole for fitting the carrier on the tool body are arranged in a row along the longitudinal axis of the carrier.

4. The device according to claim 3, wherein the retaining means comprises an elongate bowed member hinged at one end to the carrier and engageable with the carrier at its other end, said bowed member lying across the flanges of all the sets of expanding elements.

5. The device according to claim 4, wherein the bowed member is resilient and its free end can be latched over the edge of the carrier.

6. The device according to claim 5, wherein the bowed member has a hairpin shape.

7. The device according to claim 1, wherein the retaining means comprises spring elements provided in pairs on the carrier and which define the orifices therebetween for the several sets of expanding elements and spaced from the carrier by a distance corresponding to the thickness of the flanges of the sets of expanding elements.

8. The device according to claim 7, wherein the spring elements are partially stamped from a sheet-metal strip, and include the orifices for the sets of expanding elements, and separating gaps alternately in a row.

9. The device according to claim 8, wherein the orifices are open-ended for receiving the sets of expanding elements, and the separating gaps extend at right-angles to the outer edge of the sheet-metal strip.

10. The device according to claim 9, wherein the orifices are rounded in a semi-circular shape at their closed ends, the diameter of the semi-circle corresponding to the diameter of the expanding elements.

11. The device according to claim 8, wherein the carrier and the spring elements are formed from a sheet-metal strip bent to the shape of a U, the spring elements being arranged in one limb of the U, and the other limb formed by the carrier, and the width of the base of the U corresponding to the thickness of the flanges of the sets of expanding elements.

12. The device according to claim 7, further comprising openings in the carrier which register with the orifices for the sets of expanding elements.

13. The device according to claim 7, wherein the carrier is provided with two angled tongues, at the unconnected end thereof, the gap between which corresponds to the width of a lever associated with the tool.

* * * * *

UNITED STATES PATENT AND TRADEMARK OFFICE

CERTIFICATE OF CORRECTION

PATENT NO. : 4,144,735
DATED : March 20, 1979

INVENTOR(S) : Günter Rothenberger

It is certified that error appears in the above-identified patent and that said Letters Patent are hereby corrected as shown below:

Col. 6, line 14, insert "for" before "enlarging".

Col. 6, line 16, insert "diameter" after "outside".

Signed and Sealed this

*Fourteenth* Day of *August 1979*

[SEAL]

*Attest:*

*Attesting Officer*

LUTRELLE F. PARKER
*Acting Commissioner of Patents and Trademarks*